United States Patent [19]

Beatty et al.

[11] Patent Number: 5,003,802

[45] Date of Patent: Apr. 2, 1991

[54] DIAL AND DIAL RING ASSEMBLY WITH DETENTING FEATURE

[75] Inventors: Scott M. Beatty, Nicholasville; John R. Bishop, Lexington, both of Ky.

[73] Assignee: Sargent & Greenleaf, Inc., Nicholasville, Ky.

[21] Appl. No.: 443,240

[22] Filed: Nov. 30, 1989

[51] Int. Cl.[5] ..... E05B 63/00

[52] U.S. Cl. ..... 70/333 A; 70/327

[58] Field of Search ..... 70/333 A, 332, 334, 70/327, 328, 330

[56] References Cited

U.S. PATENT DOCUMENTS

| | | | |
|---|---|---|---|
| 430,145 | 6/1890 | Peck | 70/334 |
| 1,989,780 | 2/1935 | Woodward | 70/327 |
| 3,045,466 | 7/1962 | Herlong | 70/333 A |
| 3,436,941 | 4/1969 | Patzick | 70/327 |

*Primary Examiner*—Robert L. Wolfe

*Attorney, Agent, or Firm*—Mason, Fenwick & Lawrence

[57] ABSTRACT

A combination lock dial ring and rotatable dial assembly for combination locks and the like designed to provide limited range top reading of the dial indicia and graduations, including a rotatable dial component having a circular dial formation and a knob formation integral therewith, wherein the dial formation has a peripheral flange formation providing a cylindrical outer surface on which dial graduation marks and numeral indicia are provided. A dial ring member includes a generally circular base wall portion and an interrupted cylindrical annular shield portion defining a forwardly opening cylindrical well to receive said dial formation nested therein. An annular detenting land formation is provided inwardly adjacent the cylindrical shield portion defining a detenting surface having a number of dial graduation marks. A resilient biased detenting plunger is provided in the dial peripheral flange formation to interact with the detenting slots to locating the graduation marks in precise alignment with a fixed index mark on the dial ring.

3 Claims, 2 Drawing Sheets

DIAL AND DIAL RING ASSEMBLY WITH DETENTING FEATURE

BACKGROUND AND OBJECTS OF THE INVENTION

The present invention relates in general to combination locks, and more particularly to dial and dial ring assemblies for combination locks having a shielding portion to afford security against unauthorized observation of the combination being dialed when opening the lock.

It is long been recognized that the dialing for combination locks are subjected to theft by unauthorized viewing successive registrations of dial markings occurring during opening of the lock. Where such a lock is opened in the presence of other persons, it is a simple matter for each person to note the combination from a point to the side of or at angles to the rear or over the shoulder of the operator and thereby gain unauthorized access to the vault, safe or other security receptacle protected by the lock. Even where some restriction of the field of view is achieved, persons do not have to see the entire combination dialed at one time, but can learn one number each time the unauthorized observer is able to look at the dial when the combination is being dialed by an authorized person, and thus over a short period of time acquire knowledge of the dialing combination without arousing suspicion of the unauthorized person opening the safe. Ideally, the dial should expose the indicia or numbers of the combination actually being run only to the authorized observer and not anyone standing elsewhere. Heretofore, various expedients have been proposed for use in connection with conventional combination lock dials, which shield the greater portion of the dial from view by unauthorized persons. These are generally taken the form of a shield or cover provided with a window exposing only a limited number of the dial markings to view, either from a direction forwardly of the dial, or in some cases from a direction directly above the dial where the dial markings and numerals are merely provided on a peripheral cylindrical flange surface of the dial. Such dial shields have the dual purpose of hampering observation of the dial numbers by possible surreptitious observance from locations to either side of the operator while the operator is dialing the combination, and limiting the range of exposed dial markings which are visible so that the body of the operator will shield the exposed dial area from observation by person at remote locations to the side of the operator. However, the earlier proposed dial shields where commonly in the form of additional accessories which must be associated with the combination lock and dial, and in many cases afforded such a limited visible dial area that the lock dial must be operated very slowly in order to bring the proper numbers on the dial into registrary with the index mark or zero mark on the dial ring. Also, because of the restricted visible dial area, the numbers are often so obscure or difficult to count that the operator must make a number of attempts before the successful combination is dialed.

U.S. Pat. No. 2,836,052 to Harry C. Miller, U.S. Pat. No. 2,728,215 to Bremer, and U.S. Pat. No. 2,858,692 to Deaton et al., are typical of prior art dial shield arrangements proposed to restrict viewing of the dial numbers during operation of the combination lock dial.

Prior U.S. Pat. Nos. 4,163,376 to Benson L. Miller et al, U.S. Pat. No. 3,968,667 to Klaus W. Gartner et al, and U.S. Pat. No. 4,796,446 to Harry C. Miller et al., all owned by the assignee of the present application, disclose the type of dial shielding facility provided on the dial ring to encircle and shield all but a limited circumferential portion of the cylindrical periphery of a combination lock dial and knob having the dial markings on the cylindrical periphery, as commercially provided by the assignee of the present application for many years, to reduce the change of unauthorized viewing of the combination while it is being dialed by an authorized operator.

An object of the present invention is the provision of a novel combination lock dial and dial ring assembly for combination locks and the like, wherein detenting of the dial relative to the dial ring is provided at a number of equally circumferentially spaced angular positions corresponding to the number of graduation marks on the dial periphery to facilitate exact alignment of the markings on the dial periphery with the fixed index mark on the dial ring and improve the feel of the dial rotation. By thus facilitating exact alignment of the dial markings with the index mark on the dial ring, more precise and accurate setting of the combination during the combination change procedure of the lock is facilitated, so as to avoid combinations being set with the dial being off a portion of a number, which in combination locks built with great precision to minimize surreptitious entry techniques might otherwise cause difficulties in attempted dialing of the proper combination. Also accurate angular positioning of the dial at the proper annular position during dialing of the proper lock-opening combination is facilitated.

Other objects, advantages and capabilities of the present invention will become apparent from the following detailed description, taken in conjunction with the accompanying drawings illustrating a preferred embodiment of the invention.

DETAILED DESCRIPTION OF A PREFERRED EMBODIMENT

Figure 1:
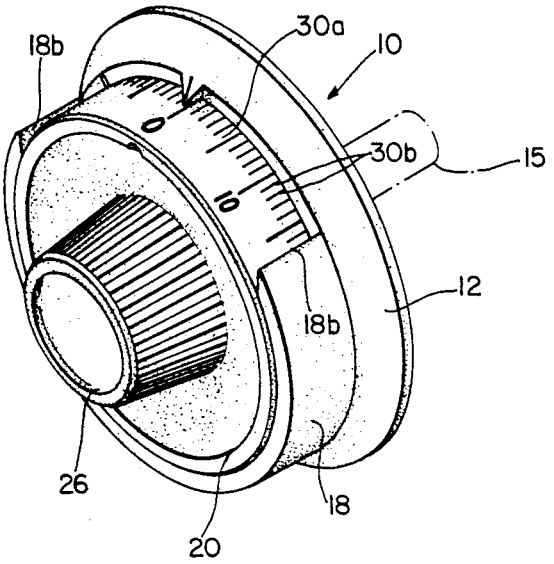
FIG. 1 is a perspective view of a dial and dial ring assembly for combination locks embodying the present invention, viewed from the front.

Referring to the drawings, wherein like reference characters designate corresponding parts throughout the several figures, the combination lock dial and dial ring assembly of the present invention is indicated generally by the reference character 10 and comprises a dial ring member 12 of generally circular front elevation adapted to be mounted against the outer surface of a safe door, file cabinet door, or a door to a security enclosure of any type, the dial ring to be mounted in a conventional manner as by mounting screws or bolts extending through screw holes, indicated at 13*a*, 13*b*, above and below a center spindle hole 14 into the supporting door, file cabinet front wall or the like. The dial ring 12 in accordance with conventional practice is to be mounted in concentric relation with the center axis of a spindle, shown in phantom lines in FIG. 1 and designated by the reference character 15, passing through a suitable opening in the door or front cover into a combination lock housing (not shown) usually of generally rectangular configuration and housing a plurality of tumbler wheels, a driving cam, a fence lever pivotally coupled to a bolt, and a suitable tumbler post for rotatably supporting the tumbler wheels and the spindle. Examples of such conventional combination locks may be found in prior U.S. Pat. No. 4,796,446 to Harry C. Miller et al., U.S. Pat. No. 4,163,376 to Benson L. Miller et al., or U.S. Pat. No. 3,986,667 to Klaus W. Gartner et al., all assigned to the assignee of the present application, as typical examples of such combination locks.

The dial ring 12 in the illustrated example is designed for top reading, and comprises a generally circular base wall portion 16 having an outer tapered rim portion 17 joined integrally by a forwardly opening, generally cylindrical but circumferentially interrupted annular cylindrical shield formation 18 defining a forwardly opening, generally cylindrical well or cavity 19 to receive the dial portion of an integral dial and knob member 20. The base wall portion 16 includes an annular land or terrace surface portion 21 located immediately inwardly adjacent the shield formation 18 and extending radially inwardly for a predetermined distance slightly greater than the maximum thickness of the shield formation 18, such that the shield formation 18 and the tapered outer rim portion 17 collectively span a radial distance substantially corresponding to the radial distance spanned by the forwardly facing annular land portion 21.

The central annular region of the base wall portion 16 lying between the cylindrical annular collar formation 22 bounding the center opening 14 for the spindle and the innermost edge of the annular land portion 21 is provided with a plurality of sector shaped openings 23 interrupted by radial spoke formations 24, six of such sector shaped openings 23 and spoke formations 24 being shown in the illustrated embodiment. Two of the spoke formations here indicated as 24*a* and 24*b* extending directly upwardly and directly downwardly from the annular collar formation 22 along the vertical plane through the center axis of the dial ring 12 and spindle opening 14 are enlarged intermediate their upper and lower junctures with the annular collar formation 22 and the portion forming the annular land portion 21 to define the mounting screw openings 13*a* and 13*b*.

The integral dial and knob member 20 has substantially the same exterior appearance as that of the above-identified U.S. Pat. Nos. 4,796,446 and 4,163,376 and comprises a substantially truncated conical or cylindrical knob formation 26 which has a knurled truncated conical surface in the illustrated embodiment, and includes a cylindrical boss 27 at the rear face thereof to encircle and receive the forward end of the dial spindle 15 in the socket 28. The cylindrical boss 27 has a diameter approximating the diameter of the spindle opening 14 in the annular collar formation 22 of the dial ring to telescopically project into and be journalled by the opening 14. An outwardly projecting and somewhat forwardly inclined disc portion 29 extends from the truncated conical knob formation 26 forming a somewhat convex forwardly facing surface of the dial and knob member immediately outwardly of the knob portion, and joins an annular peripheral portion 30 defining a rearwardly projecting peripheral flange formation having a cylindrical radially outwardly facing surface 30*a* which carries dial graduation and numeral markings, indicated at 30*b*. As will be apparent from consideration of the drawings, the interrupted annular shield formation 18 of the dial ring member 12 forms an outwardly encircling sight barrier to visual observation of the dial numeral indicia and graduation marks 30*b* from positions radially or located transversely sidewise or laterally from the dial and knob member 20, except for an approximately 80° circumferential zone located vertically above the axis of the dial and knob member and forwardly thereof. This restricted viewing zone is defined by the viewing interruption, gap or opening 18*a* arranged symmetrically with respect to the vertical center plane through the center axis of the dial and knob member 20 and bounded by the shoulders 18*b* bounding the interruption 18*a* in the shield formation 18.

Figure 2:
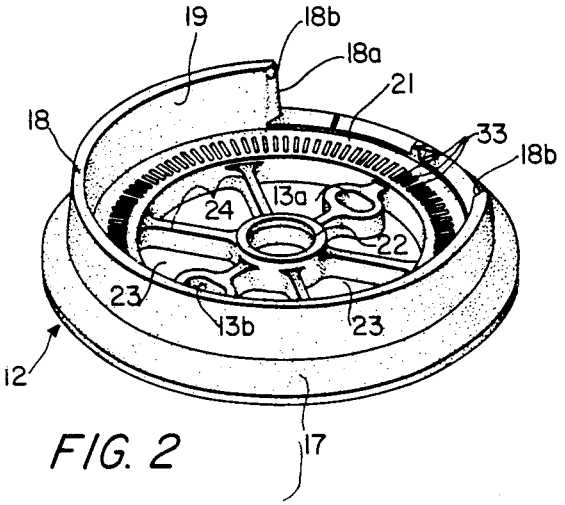
FIG. 2 is a front elevational view of the dial ring, with the dial and knob component removed therefrom.
Figure 3:
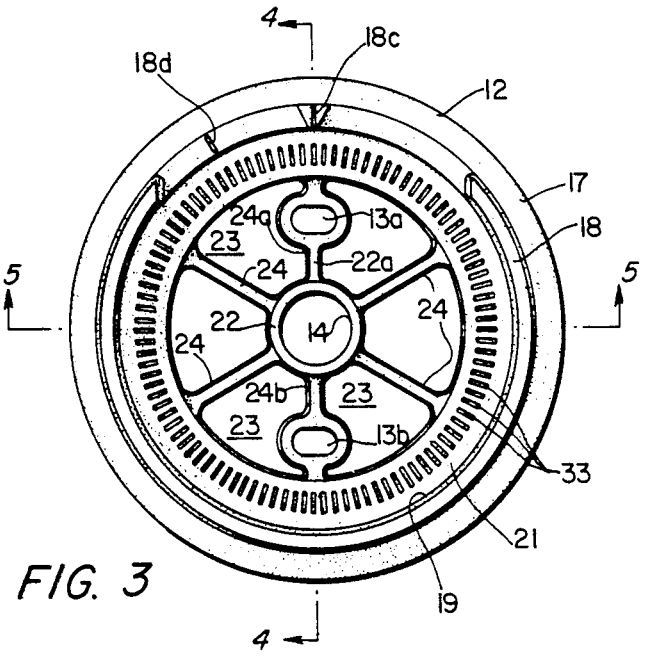
FIG. 3 is a front elevational view of the dial ring, with the dial component removed.
Figure 4:
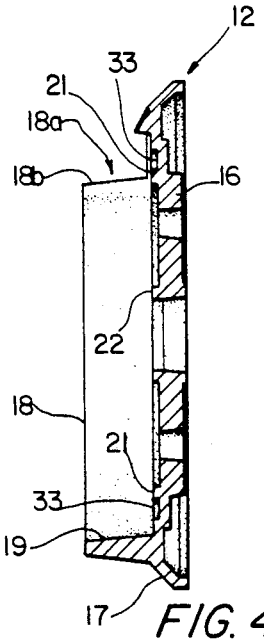
FIG. 4 is a vertical section view of the dial ring, taken along the line 4—4 of FIG. 3.
Figure 5:
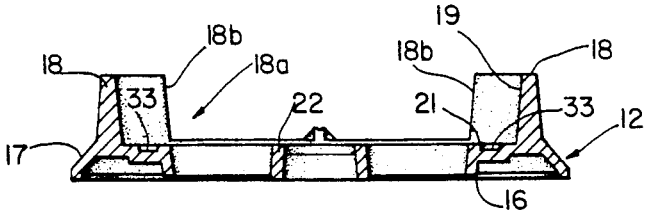
FIG. 5 is a horizontal section view of the dial ring, taken along the line 5—5 of FIG. 3.
Figure 6:
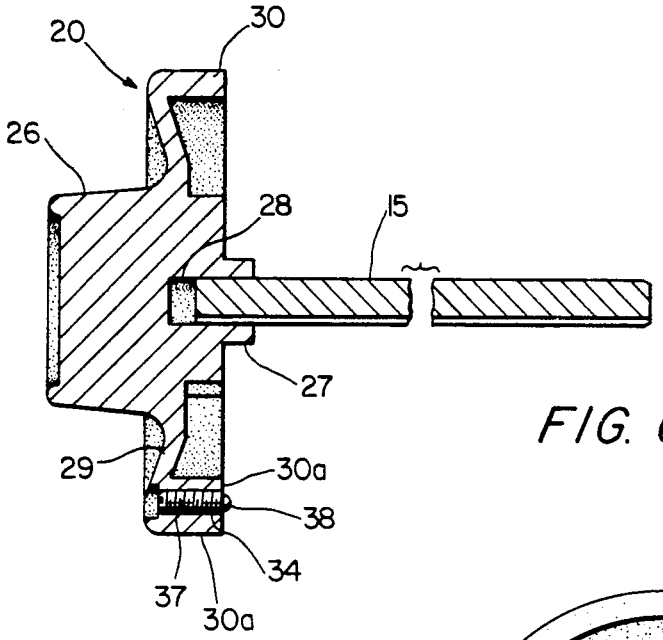
FIG. 6 is a horizontal section view of the integral dial and knob component.

As illustrated particularly in FIGS. 2, 3 and 4, the forwardly facing surface of the land or shoulder like surface formation 21 immediately inwardly of the encircling shield formation 18 is provided with a circumferentially spaced plurality of detenting recesses, herein indicated by the reference character 33, which are in the form of relatively shallow radially elongated slot-like detenting cavities or recesses, one hundred of which are provided in the preferred embodiment spaced equally along a circular path throughout the entire circumference of the land portion 21. These radially elongated shallow detenting recesses 33 may, in a preferred embodiment, be about 0.160, plus or minus 0.020 inches long with about 5 inclination of the sides, in relatively outwardly diverging direction and may be about 0.020 inches deep (plus or minus 0.005).

Figure 7:
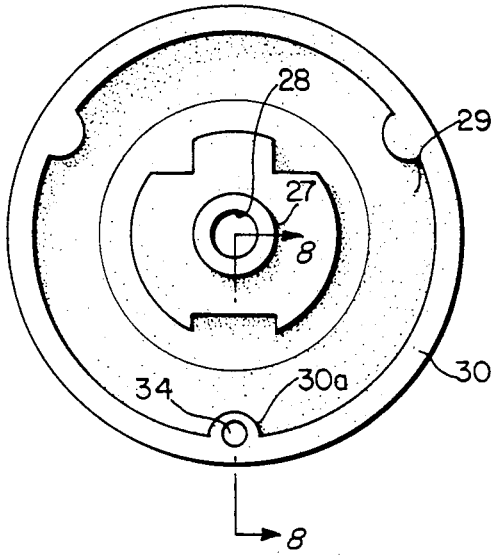
FIG. 7 is a rear view of the dial component.
Figure 8:
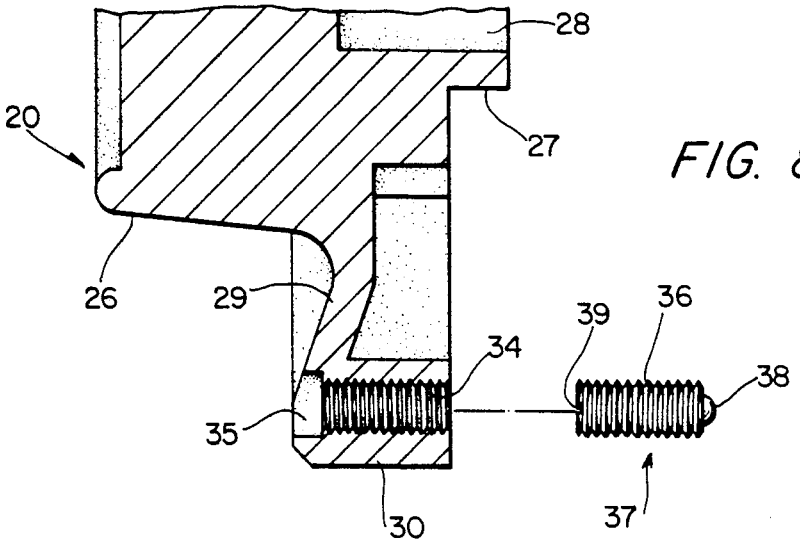
FIG. 8 is a fragmentary exploded section view of part of the dial component and detenting spring-biased ball and housing shell, taken along line 8—8 of FIG. 7.

To coact in detenting relation with these detenting recesses so as to cause the graduation marks on the dial periphery to line up exactly with the dialing index mark, as indicated at 18*c* or the combination change index mark, as indicated at 18*d*, on the dial ring, the peripheral flange portion 30 of the dial at about the 6 o'clock or lowermost position is somewhat enlarged, as can be seen in FIG. 7 and is indicated at reference character 30*a*, and is provided with a cylindrical bore 34, best shown in FIG. 8, opening through the rear face of the peripheral dial flange 30 and communicating at its forward most end with a slightly enlarged cylindrical cavity 35. The cylindrical bore 34 is sized to receive an externally threaded tubular shell spring plunger housing 36 of a detenting spring plunger assembly 37. The bore or hole 34 in the peripheral flange 30 of the dial is a tapped hole through the dial and the shell-like housing 36, such as a commercially available plunger insert marketed under the name NYLOK insert, is threaded therein. The spring plunger assembly also includes a movable plunger member 38 having a protruding spherical ball-like surface resiliently urged by a coil spring captured within the hollow bore of the shell-like tubular housing 36 so as to resiliently project into the detenting recesses 33. The spring plunger assembly 37 has a diametric slot as indicated at 39 in its forwardly facing end, which is exposed to adjustment by a screw driver bit or similar tool at the enlarged cavity or socket portion 35 so that the user can adjust the amount of detenting spring pressure desired.

We claim:

1. A combination lock dial ring and rotatable dial assembly for combination locks and the like designed to provide limited range top reading of the dial indicia and graduations, comprising a rotatable dial member having a circular dial formation and a knob formation integral therewith projecting centrally forwardly therefrom, the dial formation including an annular disc portion integrally joined to and extending radially outwardly from the radially outermost part of the knob formation, a peripheral flange formation integrally joining said disc portion at its outermost region integrally joining said disc portion at its outermost region having a cylindrical radially outwardly facing surface concentric with a center axis of the dial member, said outwardly facing surface carrying dial graduation marks and numeral indicia for a selected number of different angular dialing positions of the dial member, a dial ring member including a generally circular base wall portion having a fixed index mark and having near its outermost edge a forwardly projecting, generally cylindrical annular shield portion defining a forwardly opening cylindrical well to receive said dial formation nested therein, the shield portion having a circumferential interruption defining an opening for limited range view of the dial graduation marks, the base wall portion immediately radially inwardly of the cylindrical shield portion having an annular detenting land formation defining a ring-like forwardly facing detenting surface having circumferentially spaced detenting recesses in the forma of shallow radially elongated slot-like detenting cavities equalling in numbers said selected number of dialing positions, and said peripheral flange portion of said dial member having an axially elongated, rearwardly opening plunger-receiving bore having a center axis paralleling the axis of rotation of the dial member and housing a resiliently biased detenting plunger means, including a movable plunger having a protruding contact surface resiliently urged into said slot-like detenting recesses of said annular detenting land formation to resiliently urge the dial member to angular positions locating said graduation marks thereon in precise alignment with the fixed index mark on said dial ring, said plunger means including an elongated tubular casing threaded in said plunger-receiving bore for axial adjustment along the plunger-receiving bore upon rotation of said casing, the casing having said plunger supported therein for relative movement axially thereof and enclosing a coil spring captured therein bearing against said plunger, said plunger-receiving bore being a tapped opening, and said casing having a threaded exterior intercoupled with the threaded surface of said tapped opening and a forward end of the casing located within said plunger-receiving core and having a diametrical slot to receive a bit of a tool for rotating the casing for adjustment of the resilient detenting interacting forces between the plunger contact surface and the walls of the detenting cavities.

2. A dial ring and dial assembly as defined in claim 1, wherein said slot-like detenting cavities have oppositely sloping sides extending in outwardly diverging relation to exert forces on the contact surface of said plunger camming the plunger out of interfitting penetrating relation with the cavities upon rotation of the dial.

3. A dial ring and dial assembly as defined in claim 1, wherein said slot-like detenting cavities have oppositely sloping sides extending in outwardly diverging relation and spaced substantially equidistant from the longitudinal axes of the respective slot-like detenting cavities to exert forces on the contact surface of said plunger camming the plunger out of interfitting penetrating relation with the cavities upon rotation of the dial.

* * * * *